United States Patent [19]

Economopoulos et al.

[11] 4,332,630

[45] Jun. 1, 1982

[54] CONTINUOUS COOLING OF LOW CARBON STEEL WIRE ROD

[75] Inventors: Marios Economopoulos, Liege; Nicole Lambert, Waremme, both of Belgium

[73] Assignee: Centre de Recherches Metallurgie-Centrum voor Research in de Metallurgie, Brussels, Belgium

[21] Appl. No.: 200,512

[22] Filed: Oct. 24, 1980

[30] Foreign Application Priority Data

Oct. 26, 1979 [LU] Luxembourg ..... 81824
Jan. 29, 1980 [LU] Luxembourg ..... 82114

[51] Int. Cl.[3] ..... C21D 9/52
[52] U.S. Cl. ..... 148/12 B
[58] Field of Search ..... 148/12 B, 12 R

[56] References Cited

U.S. PATENT DOCUMENTS 3,940,294 2/1976 Sergeant ..... 148/12 B
4,165,996 8/1979 Paulus ..... 148/12 B
4,168,993 9/1979 Wilson et al. ..... 148/12 B

FOREIGN PATENT DOCUMENTS 877793 9/1961 United Kingdom .
1233522 5/1971 United Kingdom .

*Primary Examiner*—W. Stallard
*Attorney, Agent, or Firm*—Holman & Stern

[57] ABSTRACT

Low carbon steel (C≦0.4%) wire rod at 800°-880° C. from a rolling mill is deposited in loose turns on a conveyor where it is slowly cooled until the austenite to ferrite transformation is at least 80% complete and the ferrite grain size is at lest ASTM 9 and is then rapidly cooled to 350°-560° C. Thereafter, the wire rod, e.g. on the conveyor or in coils, is subjected to a slow-cooling stage functioning as an overaging stage.

22 Claims, 3 Drawing Figures

900
T(°C)
800
700
600
500
400
300
200
T
Z
(% AUSTENITE TRANSFORMED)
Z(%)
100
80
60
40
20
0
12.5
25
37.5 LENGTH (m)
50
25
50
75
100
125
150 TIME (s)

900
T(°C)
800
700
600
500
400
300
200
T
Z
(% AUSTENITE TRANSFORMED)
Z(%)
100
80
60
40
20
0
12.5
25
37.5 LENGTH (m)
50
25
50
75
100
125
150 TIME (s)

CONTINUOUS COOLING OF LOW CARBON STEEL WIRE ROD

BACKGROUND OF THE INVENTION

1. Field of the Invention

This invention relates to methods for the continuous cooling of wire rod of low carbon steel (C≦0.4% and preferably C≦0.15% ).

On discharge from a rod mill, wire rod is subjected to a controlled cooling operation whose operating parameters depend on the final properties with which it is desired to provide the rod.

Taking into account the composition of the rod and the final properties with which it is desired to provide the rod, it is possible to vary to a considerable extent the duration, the number, the type, and the intensity of the various stages of the complete cooling process.

The large size of the plants for carrying out the required cooling is a further aspect of the problem, and in particular their dimensions in the longitudinal direction, which may considerably affect the capital required to construct them.

Consequently an improvement of any one of the stages of a rod cooling process may have an effect on the quality of the rod, the time required to completely cool the rod, the size of the corresponding plants, and therefore on both their operating and first installation costs and on the homogeneity of the mechanical characteristics.

There are at present numerous method of subjecting wire rod, on discharge from the mill, to a specific cooling sequence, often specifically designed for the required rod quality.

In the case of extra mild steel rod, it is essentially attempted to obtain an elastic limit (E), a tensile strength (R), and an E/R ratio which are as low as possible. It is therefore necessary, in the finished product, for the ferritic grain to be coarse and the amount of C in supersaturation in the ferrite to be minimal.

According to a known method, on discharge from the last stand of the rolling mill, wire rod of low carbon steel is subjected to cooling by spraying with water until it reaches a temperature of between 850° C. and 800° C., and then disposed in loose turns on a horizontal conveyor, where it is further cooled by still air then blown air to a temperature in the range of 200° C. to 300° C., and finally coiled at this temperature for delivery. It can therefore be seen that, in this method, a relatively intense and rapid cooling stage in the temperature range favourable to precipitation follows a holding stage at a high temperature which is relatively long and that consequently there has been little carbide precipitation when the rod has reached the coiling temperature. An operating method of this type does not appear to lead specifically to rod of a particularly mild grade, as there is no overaging stage following cooling of this type.

According to a further known method which may be applied advantageously to the manufacture of mild steel wire, on discharge from the last stand of the rolling mill the wire rod, which is again pre-cooled, is disposed in loose turns on a first conveyor, at a temperature similar to that given above; cooling is carried out slowly in air on this conveyor until the allotropic austenite to ferrite transformation is partially achieved. This stage is followed by quenching of the rod in a bath of boiling water in which the allotropic transformation is completed.

The rod is finally subjected to an overaging operation at a mean temperature of 450° C. for at least one minute and a product which is suitable for normal use as mild steel rod is thus obtained.

SUMMARY OF THE INVENTION

The present invention relates to a method of cooling wire rod which is substantially of the same type as those described above, but which has, in comparison with the above methods, the advantage that it facilitates to a large extent the achievement of mild steel (C≦0.40%) and even extra mild steel (C≦0.15%) wire rod. The method of the invention therefore substantially relates to the achievement of a wire rod whose elastic limit, tensile strength, and E/R ratio are particularly low. In addition, it is possible, in accordance with the invention, to carry out this cooling, for example, in a shorter time with a plant which is substantially of the same size, or in a shorter time with a plant which is shorter and therefore less costly.

It has in fact been discovered, in a surprising manner, that passing very rapidly from the zone in which the allotropic transformation is at least 80% complete to that in which overaging begins does not substantially modify the properties of the metal; a considerable gain in time and therefore plant length utilization is possible, which gain is particularly large in the method of the present invention.

Accordingly, the present invention provides a method in which, on discharge from the rolling mill, the wire rod is brought to a temperature of between 900° C. and 780° C. and preferably between 880° C. and 800° C. and disposed in the form of non-connected turns on a conveyor on which it is displaced, the rod in turns on the conveyor is cooled by adjusting the cooling speed to a value which is sufficiently low for the ferritic grain to have the required size, preferably at least ASTM 9, more preferably at least ASTM 10, when the allotropic transformation has taken place to at least 80% and preferably 95%, and the rod, still on a conveyor, is subjected to rapid cooling to a temperature of between 350° C. and 560° C., preferably between 450° C. and 560° C., and more preferably between 500° C. and 560° C., then to a second slow cooling stage.

This method enables the rapid achievement of mild and even extra-mild rod of very good quality, by means of a plant whose length may be lower than that which is normally used for the above-mentioned known processes.

A particularly effective manner of ensuring the rapid cooling of the rod (preferably at least 8° C./s), at the same time as controlling it, consists in providing a series of jets which spray a mist (constituted by water atomised in a fluid, such as for example air) onto the rod.

According to an advantageous mode of operation, this rapid cooling is obtained by the immersion of the rod in an aqueous bath, preferably at boiling point and possibly containing surfactants.

The slow cooling stage may be carried out in an advantageous manner while the rod is on a conveyor and/or after it has been coiled.

The main advantage of the method to the present invention consists in the fact, on one hand, that the cooling at high temperature is selected to be sufficiently slow to ensure the formation of a ferritic grain which is sufficiently coarse practically until the end of the allotropic transformation and, on the other hand, that the passage from the temperature at the end of the allotropic transformation to that at the beginning of overaging is sufficiently rapid for the amount of carbon remaining in supersaturation at the beginning of this latter stage to be as high as possible and still as high as possible at the beginning of the overaging stage and that, during the said subsequent overaging stage, the carbide precipitation is greater and more rapid. The size of the grain and the quantity of carbides precipitated play a large part in the quality of the wire rod obtained.

In comparison with the above-mentioned known methods, the method of the invention therefore enables:

the reduction to a minimum of the duration of holding the wire rod at a high temperature, whilst providing it with the required grain size and an almost complete allotropic transformation;

the reduction to a considerble extent of the passage time from the high temperature zone to the overaging zone, which has the advantage of preserving a maximum of carbon in supersaturation in the ferrite and of reducing the length of the plant;

an increase to a considerable extent of the effectiveness of the overaging on wire rod in which the supersaturated carbon content of the ferrite is still considerable, which effectiveness may be exerted for a longer period having a duration equal to the complete length of the process.

The minimum cooling speed to be respected for the time gain (and in addition the gain in utilization of the length of the installation) to be sufficiently large to be considered as advantageous, depends on the diameter of the wire rod in question. For example, for a diameter of 5.5 mm a speed of at least 8° C./s is desirable, whereas for a wire rod 12 mm in diameter a speed of at least 3° C. /s is desirable.

It goes without saying that the final characteristics obtained in the wire rod depend in principle on the duration of the slow high temperature cooling, before the rapid cooling. The greater this duration, the lower the E/R ratio and the values of R and E. For a given plant length, the mechanical characteristics depend therefore on the speed of cooling of the wire on the conveyor means.

BRIEF DESCRIPTION OF THE DRAWINGS

The invention will be described further, by way of example, with reference to the accompanying drawings, in which.

DESCRIPTION OF THE PREFERRED EMBODIMENTS

Figure 1:
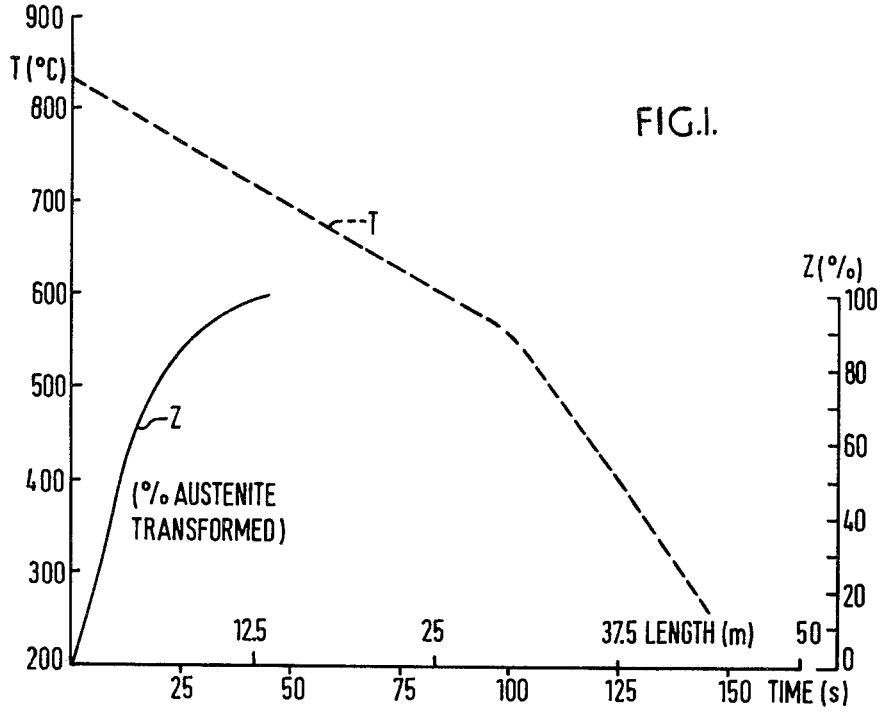
FIG. 1 is a graph of wire rod temperature, T (°C.), and percentage of austenite transformed, Z (%), plotted against the time (s) spent by wire rod on a conveyor onto which the rod is deposited in loose turns (and against the length travelled, which is proportional to the time), for a cooling method not in accordance with the invention.

FIG. 1 shows the temporal development of the temperature of a steel wire rod of 5.5 mm in diameter, whose composition is as follows: 0.05% C., 0.3% Mn, 0.0048% N. This wire rod is disposed at a temperature of 830° C. in loose turns on a conveyor which is displaced at 0.3 m/s, cooled in still air on the conveyor, and then coiled at approximately 250° C. after 150 seconds of the still air cooling; the resulting rod has a tensile strength of 370 N/MM$^2$. The length of the plant is approximately 50 m.

Figure 2:
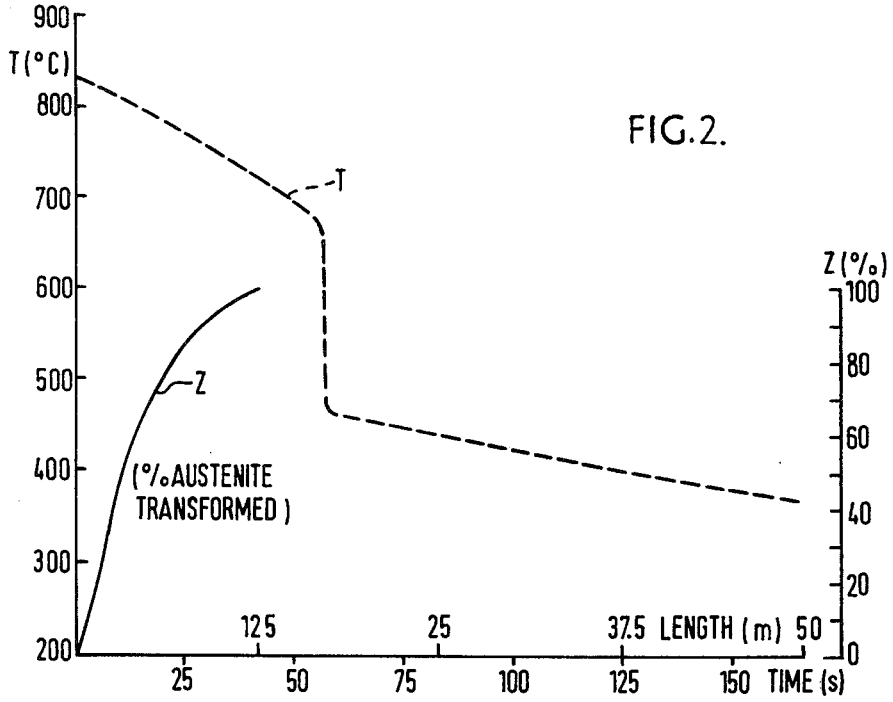
FIGS. 2 and 3 are graphs similar to FIG. 1, for two cooling methods in accordance with the invention.

The same rod, with the same conveyor disposition and speed conditions, but subjected after 55 seconds on the conveyor to rapid cooling to 460° C. and then to slow cooling (overaging stage) to reach approximately 380° C. after 150 seconds on the conveyor (FIG. 2), all the other conditions being the same, exhibited a tensile strength of 330 N/mm$^2$ and an elastic limit/tensile stength ratio (E/R) lower than 0.7, which demonstrates the advantage of the method of the present invention.

Figure 3:
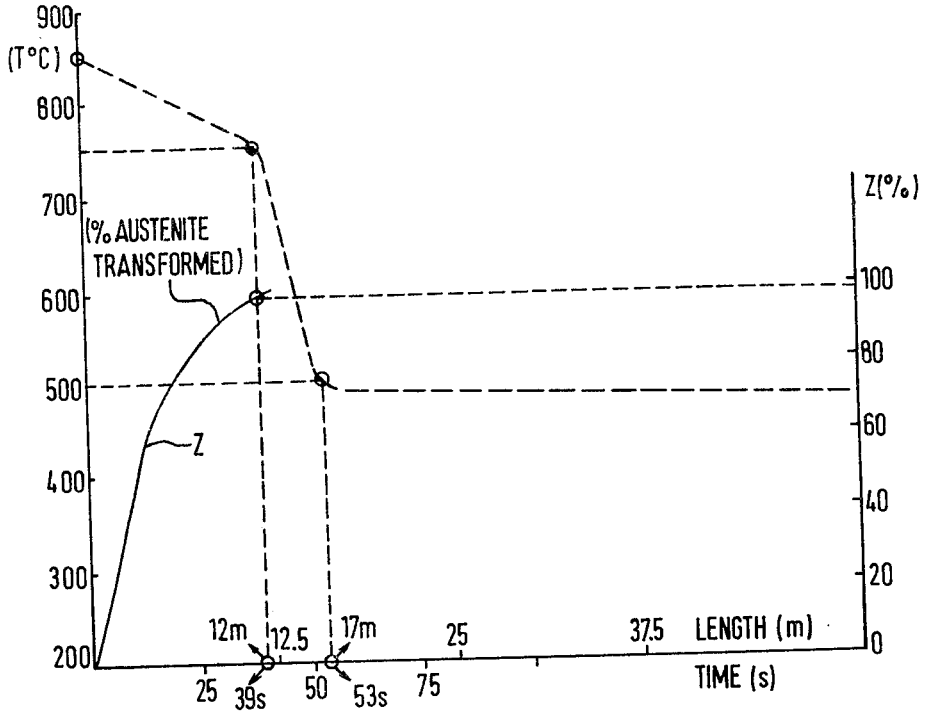

In FIG. 3, the same rod is disposed on the conveyor at 850° C., under the same conveyor speed conditions, but is subjected to cooling at 2.5° C./s to 750° C., then to rapid cooling to 500° C. in approximately 16 seconds at a speed of 16° C./s, and finally to slow cooling (overaging stage), still in loose turns, to ambient temperature. As this operation may be carried out with a plant whose length is approximately 17 m, the advantage of this mode of operation is obvious. It should be noted that the results obtained for the wire rod subjected to this treatment are: E/R=0.7 and R=330 N/mm$^2$.

Within the scope of the method decribed above, a further aspect of the problem is constituted by the size of the plants enabling the required cooling to be carried out, and in particular their dimensions in the longitudinal direction, which may play a large part in the capital required to finance these plants. Last, but not least, there are great advantages in producing wire rod whose mechanical properties are uniform and homogeneous over its entire length.

From this point of view, a greater or lesser dwell-time on a conveyor in still air may cause a difference in cooling speed and therefore in microstructure and mechanical properties, between the portions of the turns which are at the edges of the conveyor and the portions of the turns which are remote from the edges of the conveyor, i.e. in the central zone of the conveyor.

It is in fact well known that when the wire rod is disposed in loose turns overlapping on a conveyor, the major portion of the metal is concentrated in a relatively small volume at the two edges of the layer of turns whereas in the central zone of this layer the concentration of metal is less. Consequently there is a difference in the cooling development of the turns, the edges of the layer cooling less rapidly than the central zone, which is not favourable to the homogeneity of the structure of the wire rod and leads, for the rod portions located in the central zone, to mechanical properties which are not as good as those obtained for the rod portions located in the lateral zones. The procedure described below enables this drawback to be remedied.

According to this procedure, during all or part of the dwell-time of the turns on the non-immersed conveyor, the portion of the layer of turns located in the central zone of the conveyor is subjected to cooling which is less intense than that applied to the edges of the layer, so as to obtain structural homogeneity of the wire rod over all its turns.

Several methods may be used to achieve this differential cooling. It is possible for example, by means of a heat generator, to apply a gaseous fluid at a suitable temperature, which gaseous fluid is sprayed over the portion of the turns located in this central zone, the temperature of the gas sprayed in this way decreasing progressively in the direction of displacement of the conveyor. Any other means of supplying heat to the layer of turns located in the central zone may be used.

It is, however, preferable to use a means which, without actual heating, decelerates to the required extent the cooling of the central zone, in particular, all the other factors being equal, by reducing, in comparison with the rate of flow of the coolant used for the edges of the layer, the rate of flow of the coolant used for the central zone.

A further particularly advantageous means for carrying out this procedure consists in disposing above the central zone of the conveyor, and preferably only above this zone, at a given distance from the layer of turns and over all or part of its length, a screen which, on one hand, slows down the circulation of any gaseous fluid in the central zone and, on the other hand, reflects towards the upper portion of the central zone of the layer of turns the heat emitted by the central zone, in particular by radiation. It is also advantageous to provide heat insulation of the bed plates of the conveyor in the central zone.

The efficiency of the effect of this screen is a function of its own parameters, such as dimensions, type, distance above the turns, and the reflectivity of the surface of the screen facing the turns. By way of example, a screen of this type, supported by a frame of aluminium-based sections, is constituted by a steel plate which is polished on its surface facing the turns and blackened on its opposite surface.

This last embodiment has been described in the case of its particular use for the manufacture of wire rod of extra mild steel, but this is purely by way of example, as it may be used for any other catagories of wire rod, in which cooling includes an extended dwell-time in still air on a conveyor.

We claim:

1. A method for the continuous cooling of low carbon steel wire rod ($C \leqq 0.4\%$) on discharge from a rolling mill, the wire rod having been brought to a temperature of between 900° C. and 780° C., the method comprising the sequential steps of disposing the rod in loose turns on a conveyor means; subjecting the wire rod in turns on the conveyor means to a first slow cooling stage until the allotropic transformation of austenite to ferrite has taken place to at least 80%; subjecting the wire rod, whilst still on the conveyor means, to a rapid cooling stage to a temperature of between 350°0 C. and 560° C.; and subjecting the rod to a second slow cooling stage, the rapid cooling stage occuring at a rate such that at least the major part of the carbon remaining in supersaturation at the end of the first slow cooling stage is still in supersaturation at the beginning of the second slow cooling stage.

2. A method as claimed in claim 1, in which the cooling speed in the first slow cooling stage is such that the ferrite grain size at the end of that stage is at least ASTM 9.

3. A method as claimed in claim 2, in which the ferrite grain size at the end of the first slow cooling stage is at least ASTM 10.

4. A method as claimed in claim 1, in which the rapid cooling comprises spraying a mist of water in a gas.

5. A method as claimed in claim 4, in which the rapid cooling speed is at least 8° C./s.

6. A method as claimed in claim 1, in which the rapid cooling comprises immersion of the wire rod in an aqueous bath.

7. A method as claimed in claim 6, in which the aqueous bath is substantially at its boiling point.

8. A method as claimed in claim 6, in which the wire rod diameter is 5.5 mm and the rapid cooling speed is at least 8° C./s.

9. A method as claimed in claim 6, in which the wire rod diameter is 12 mm and the rapid cooling speed is at least 3° C./s.

10. A method as claimed in claim 1, in which, during at least part of the dwell-time of the turns on the conveyor means before the rapid cooling stage, the middle portion of the layer of turns is subjected to cooling which is less intense than that applied to the lateral portions of the layer.

11. A method as claimed in claim 10, in which heat is supplied to the middle portion of the layer of turns.

12. A method as claimed in claim 11, in which a gaseous fluid heated to a given temperature is sprayed on the middle portion of the layer of turns, the said temperature decreasing progressively in the conveying direction.

13. A method as claimed in claim 10, in which the intensity of the cooling of the middle portion of the layer of turns is reduced, without supplying heat.

14. A method as claimed in claim 13, in which a coolant is supplied to the layer of turns, the rate of flow of coolant to the middle portion being reduced relative to the rate of flow of coolant to the lateral portions.

15. A method as claimed in claim 13, in which the intensity of the cooling of the middle portion is reduced by arranging a screen above the middle portion.

16. A method as claimed in claim 15, in which the screen has a reflective surface facing the middle portion.

17. A method as claimed in claim 1, in which the first slow cooling stage is continued until the allotropic transformation has taken place to at least 95%.

18. A method as claimed in claim 1, in which the rapid cooling stage cools the wire rod to a temperature of between 450° C. and 560° C.

19. A method as claimed in claim 18, in which the rapid cooling stage cools the wire rod to a temperature of between 500° C. and 560° C.

20. A method as claimed in claim 1, in which the second slow cooling stage comprises cooling in coils.

21. A method as claimed in claim 1, in which the second slow cooling stage comprises slow cooling on conveyor means.

22. A method as claimed in claim 1, in which the wire rod is at a temperature of between880° C. and 800° C. when it is first disposed on conveyor means.

* * * * *